United States Patent [19]

Kaufman

[11] Patent Number: 4,704,100

[45] Date of Patent: Nov. 3, 1987

[54] BAG MAKING APPARATUS AND METHOD

[76] Inventor: Aaron Kaufman, 33-B Stratford La., Boynton Beach, Fla. 33436

[21] Appl. No.: 895,140

[22] Filed: Aug. 11, 1986

[51] Int. Cl.[4] ..... B31B 23/86

[52] U.S. Cl. ..... 493/194; 493/224; 493/226; 493/478; 493/926

[58] Field of Search ..... 493/194, 223, 224, 226, 493/231, 237, 478, 479, 34, 909, 926

[56] References Cited

U.S. PATENT DOCUMENTS

| | | | |
|---|---|---|---|
| 3,511,735 | 5/1970 | Lindley | 493/226 |
| 3,568,576 | 3/1971 | Lehmacher | 493/226 |
| 3,698,289 | 10/1972 | Kamins et al. | 493/226 |
| 3,773,591 | 11/1973 | Blair | 493/926 |
| 3,859,894 | 1/1975 | Mundus | 493/226 |
| 4,216,705 | 8/1980 | Achelpohl et al. | 493/226 |

FOREIGN PATENT DOCUMENTS

| | | | |
|---|---|---|---|
| 2356106 | 5/1975 | Fed. Rep. of Germany | 493/226 |
| 2552054 | 3/1985 | France | 493/226 |

*Primary Examiner*—Frederick R. Schmidt
*Assistant Examiner*—William E. Terrell
*Attorney, Agent, or Firm*—Thomas L. Tully; Martey R. Perman; Clarence A. Green

[57] ABSTRACT

An elongate apparatus for forming a plurality of plastic bags or pouches from a continuous length of thermoplastic film, in which the moving film is folded to form a double thickness which is open inwardly from one edge, and is folded inwardly from said one edge to form a flap ply which is treated at a plurality of aligned workstations to form physical bag features, such as to form spaced hanger-receiving slits, insert spaced hangers, form a longitudinal hanger-confining heat seam, fold out the flap ply, apply spaced adhesive closures, form V-cuts in the flap ply and fold back the flap ply to overlie the double ply prior to forming heat-seal transverse cuts which segregate the web into a plurality of plastic bags or pouches. A preferred embodiment comprises mounting each of the workstations on a carriage member which is normally fixed relative to the frame of the apparatus but is releasable for movement along the direction of the web, while the web is moving, in order to reposition the workstations simultaneously relative to the locations of the heat seal transverse cuts whenever the moving web creeps or otherwise loses alignment and causes the physical bag features to become off-center relative to the transverse cuts.

11 Claims, 8 Drawing Figures

BAG MAKING APPARATUS AND METHOD

BACKGROUND OF THE INVENTION

The present invention relates to a method and apparatus for the continuous automatic manufacture of a plurality of plastic bags or pouches from a continuous web of thermoplastic film, such as polyethylene, polypropylene, etc. Such plastic bags are used for a variety of purposes, including the display-packaging of small articles of clothing, small parts for the automative and electronic fields, etc.

Bags of this general type are now formed to some degree of completion on conventional elongate side-weld bag-making machines and pouch bag-making machines commercially available under the trade names Shejldal by Webster Industries, Poly Star by Rowan Industries, FMC and other companies. Such machines are either split tandem machines which process two webs of film, side-by-side, to simultaneously form bags along each side of the machine, or single web machines which process a single web of film..

Reference is made to U.S. Pat. Nos. 3,670,947, 3,782,622 and 4,590,610 for their disclosure of plastic bags incorporating closure flaps and hangers, and to U.S. Pat. No. 4,385,722 for its disclosure of such bags and an apparatus for manufacturing the same from a continuous web of thermoplastic film, although the hangers thereof must be inserted manually and secured by means of adhesive.

In most commercially-available plastic bags of the present type, incorporating hangers, the hangers are heat-fused to the bags either within the flap or external thereto. This requires that the film and the hangers consist of the same thermoplastic composition so that they fuse together at the same temperature. However, in many cases it is desirable to produce bags from different plastic films without being concerned about the composition of the hangers.

The known conventional continuous bag-making machines are unsatisfactory for the automatic production of bags of the type disclosed in U.S. Pat. No. 4,590,610, having hangers loosely confined within an upper flap portion, due to the absence of any known means for automatically inserting the hangers thereof, and due to the difficulty of maintaining even manually-inserted hangers in centered position relative to each bag-width because the tension applied to cause movement of the continuous web causes the web to creep or stretch out of alignment so that the hangers become off-center. When alignment or longitudinal integrity is lost, the physical features applied at the workstations become off-center relative to the final transverse cuts, to form disfigured and unsatisfactory bags. This requires that the machine be shut down and readjusted. For each minute of down time a tandem machine is not making bags at the normal rate of 120 to 140 per minute, 60 to 70 per side. Most importantly, the machine operator must manually readjust the positions of each of the workstations, relatively to each other and to the final cutting station, so that the hangers are attached in centered position, the flaps are properly cut, the adhesive tabs are centered, etc. This is time consuming and requires multiple trial and error adjustments before all bag features are perfectly centered and aligned.

SUMMARY OF THE INVENTION

The present invention relates to a method and apparatus for correcting or reducing the problems inherent in prior-known methods and machines for the automatic production of plastic bags from continuous thermoplastic films, and for automatically producing plastic bags having confined hangers consisting of composition which may be different from that of the film, including nonfusible materials such as cardboard, metal or wood.

One embodiment of the present invention is based upon the discovery that the problems caused by the loss of alignment of a continuous film web being processed on an elongate bag-making machine, relative to the workstations, can be corrected in relatively simple and rapid manner by mounting the workstations, which engage and process one edge of the web, on a carriage member which can be unlocked and moved a slight distance along the length of the web, while the film web is still moving, to reposition or center all of the workstations simultaneously relative to the final bag-cutting station. Since the workstations are fixed to the carriage in the desired spaced relationship, movement of the carriage does not necessitate any readjustment of the workstations. The stretching or creeping of the web is not corrected by the repositioning of the carriage relative to the moving web, but rather is compensated for, in order to produce relatively perfect bags even while the web is in such condition. Also, the operation of the machine, during the repositioning of the carriage, reduces the amount of waste of time and material, since the correction can be made in a matter of seconds as the web continues to move.

Another embodiment of the present invention is based upon the discovery of a novel mechanism for automatically feeding plastic hangers outwardly from the machine and under the flap ply along one edge of a continuous plastic film bag web in order to adapt conventionaly bag-making and pouch-making machines to the automatic production of hangered bags in which each hanger is loosely confined within the flap ply with its hook portion extending through an opening therein.

THE DRAWINGS

FIG. 1A and 1B comprise a plan view of a conventional elongate side-weld bag making machine incorporating an adjustable workstation carriage assembly according to the present invention;

FIG. 2 is a perspective view of the adjustable carriage assembly of FIG. 1, illustrating the relative attachment positions of the workstations thereon;

FIG. 3 is a perspective view of an adjustable-slot-cutting workstation present on the carriage assembly of FIG. 1A;

FIG. 4 is a perspective view of a hanger-feeding magazine workstation present on the carriage assembly of FIG. 1A;

FIG. 5 is a perspective view of a hanger-inserting workstation present on the carriage assembly of FIG. 1A, FIG. 6 is a perspective view of a seal bar assembly workstation present on the carriage assembly of FIG. 1A, and FIG. 7 is a perspective view of a hanger-positioning workstation present on the carriage assembly of FIG. 1A.

DESCRIPTION OF THE DRAWING

FIG. 1 essentially illustrates only one-half of the width of the apparatus 10 in detail since the other half is a mirror-reverse duplication thereof.

The apparatus 10 comprises the conventional basic rectangular machine framework including upper and lower side rails, front and rear end rails, cross rails and leg rails, positioned to provide a sturdy support for the mechanical and electrical components of the apparatus. FIG. 1 illustrates only those elements of the framework which are essential to the support of the novel carriage assemblies of the present invention and to the support and processing of the film web since the basic framework is conventional in known side weld bag making and pouch making machines.

Referring to FIG. 1 the apparatus 10 comprises elongate upper side rails 11, a capstan support 12 at the rear, film-entry end and a bag cutter support 13 at the front, bag-stacking end of the apparatus. Associated with the apparatus 10 is a conventional film web roll stand 14 including an edge guide 15, for controlling the dispensing of the roll of film 16 to maintain the film edges straight, and a conventional adjustable folding board 17 for automatically folding the film 16 widthwise at any desired point across the width of the film 16 to provide a two-ply web 18. In order to produce film bags of the type illustrated by FIG. 1, the web 18 is folded along fold line 9 to provide a wider lower film ply which extends beyond the end 20 of the upper film ply to provide a flap extension 21. The web 17 passes at a uniform speed over roller 22 under floating roller 23 and over another conventional folding bar and wire which folds the flap extension 21 along a flap fold line 24 to form a flap length 25 which extends over and beyond the end 20 of the upper film ply. The folded bag web 26 then passes over roller 27 and into the workstations of the apparatus 10 for processing into hangered bags. The capstan rollers 22 and 23 withdraw the film web from the roll stand 14 at a continuous uniform speed even though the folded web 26 moves intermittently through the workstations.

Figure 1A:
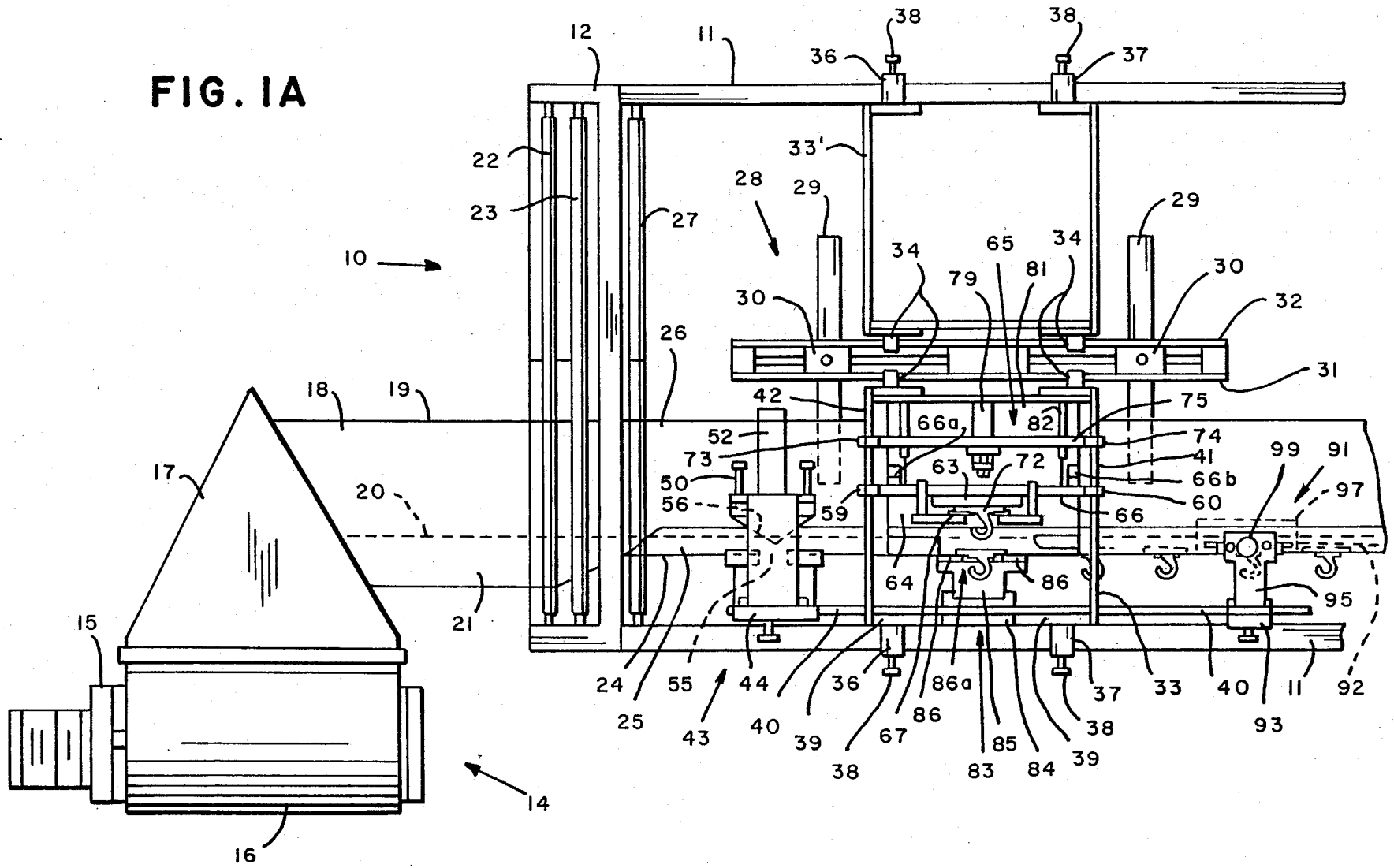
Referring to FIG. 1, comprising FIGS. 1A and 1B, the apparatus thereof comprises the segmented frame of an elongate side weld tandem bag-making apparatus 10, said frame generally having a length of about 15 feet and a width of from 3½ to 5½ feet to accommodate the processing of two side-by-side film webs in tandem.

According to a preferred embodiment of the present invention, the workstations are adjustably attached to a carriage assembly 27 which in turn is adjustably attached to the side rail 11 of the apparatus 10, to permit each of the workstations to be fastened to the carriage in predetermined positions, relative to each other, and to permit all of the workstations to be moved in unison whenever it becomes necessary to recenter the bag features, i.e., the hanger, flap contour, adhesive tab, etc., due to creepage of the film.

The novel carriage assembly 27 comprises an elongate pedestal rail stand 28 comprising transverse, spaced lower floor supports 29 or lower frame cross bars, each supporting an upright bar 30 to which a pair of parallel elongate rails 31, 32 is attached to support the rails 31, 32 a distance above the floor corresponding to the height of the side rails 11 of the side-weld bag-making machine 10, rails 31 and 32 also being parallel to and equally-spaced from the opposed side rails 11.

Figure 2:
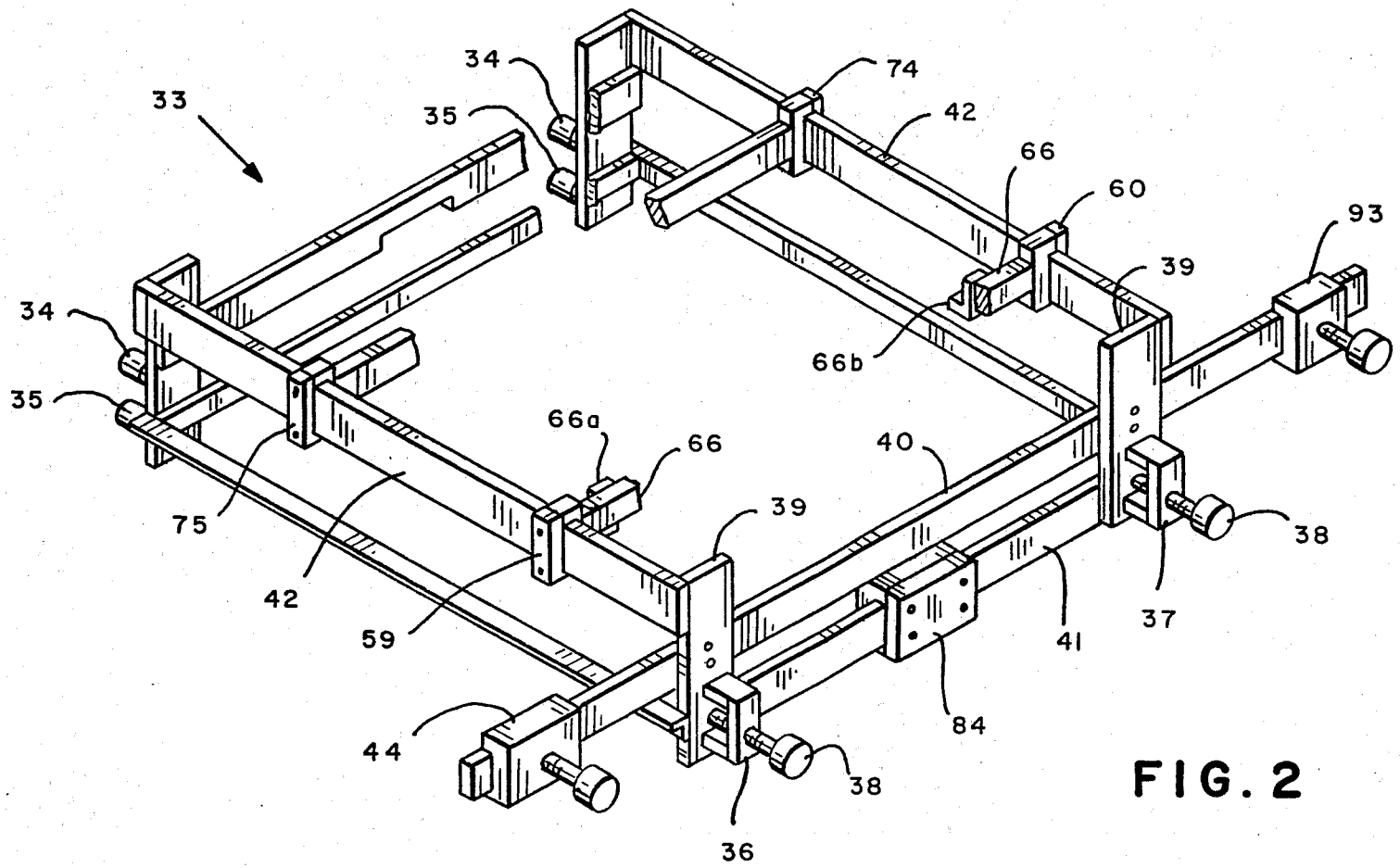

The carriage assembly 27 also comprises a pair of movable, rail-supported carriage elements 33, 33', illustrated more clearly in FIG. 2. Essentially, each carriage element 33, 33' is an identical movable, workstation-supporting frame which is supported for movement along a center rail 31, 32 by means of spaced, opposed pairs of rollers 34, 35. The top roller 34 of each pair is a round wheel which rides on the upper surface of a rail 31, 32 and the bottom roller 35 of each pair is an eccentric wheel which underlies the undersurface of a rail 31, 32. The eccentric or cam wheels 35 provide locking engagement with the underside of rail 31, 32 under the effects of rapid or jerking movement of the carriage element but permit the carriage elements 33, 33' to be pushed small distances along the length to the center rails 31, 32.

The carriage elements 33, 33' are also slidingly-engaged over the side rails 11 by means of spaced brackets 36 and 37 which are attached to opposed side corner plates 39 to confine the side rail 11 within each to permit the carriage elements 33, 33' to be moved along rails 11 as the wheels 34, 35 move along center rails 31, 32 to adjust the position of the carriage elements. The brackets 36, 37 threadably-engage knobbed bolts 38 which can be tightened to engage the side rail 11 and lock the carriage element 33, 33' in the desired position.

The carriage elements 33, 33' include workstation-supporting framework comprising the side corner plates 39 which are parallel to the machine side rail 11 and support a parallel extension arm bar 40 which extends a distance beyond the carriage framework in both directions, as shown, to provide a support arm for the workstations, a lower parallel side bar 41 and upper opposed transverse bars 42 which are perpendicular to the extension arm bar 40 to provide support for workstations within the carriage framework, as shown more clearly in FIG. 2.

FIG. 2 illustrates portions of the adjustable clamping members of the workstations of FIGS. 3 to 7, to show the relative locations of such workstations and their manner of adjustable attachment in sequential relationship relative to the flap length 25 end of the bag web 26, as shown in FIG. 1.

Figure 3:
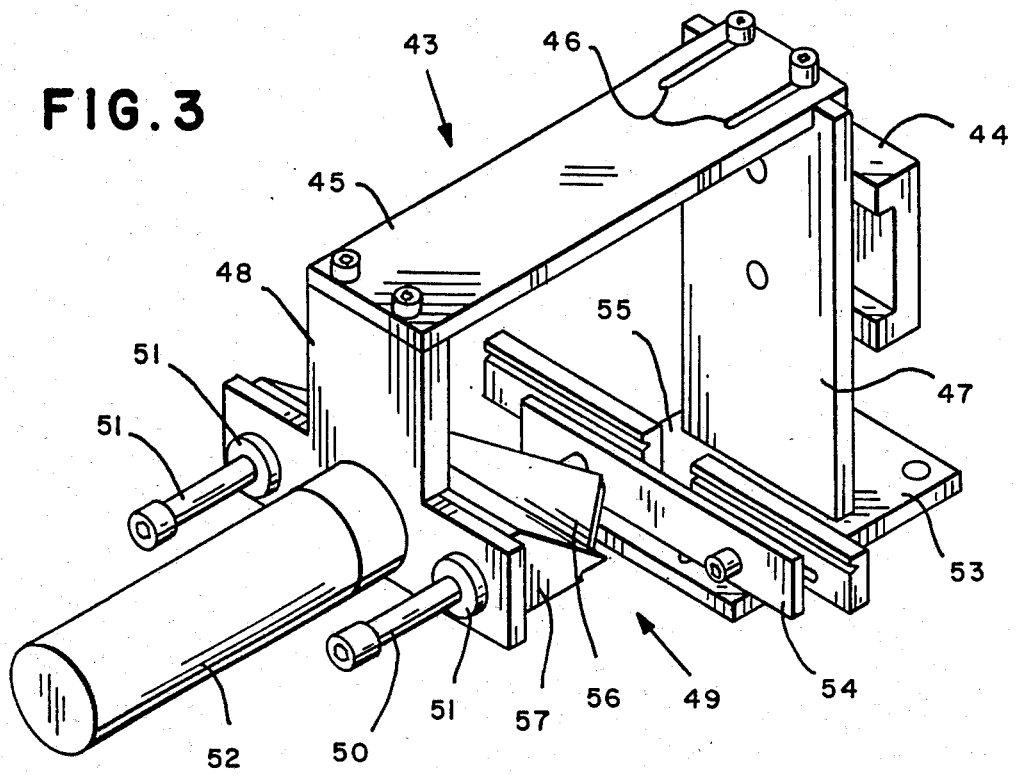

Thus, FIG. 3 illustrates the slot-cutting workstation 43 having a clamping member 44 which adjustably secures said station to the portion of the extension arm bar 40 in advance of the carriage element 33. Workstation 43 comprises a top support arm 45 having slots 46 enabling adjustable attachment to the sidewall 47, a support skirt 48 and a reciprocating slot-making blade assembly 49 mounted on skirt 48 by means of slide bolts 50, bushings 51 and pneumatic cylinder 52. Station 43 also comprises a base board 53 supporting an adjustable back-up board 54 providing an adjustable gap 55 to receive the tip of the blade 56 each time the blade assembly is extended, beneath the flap length 25, to form a slot in the fold line 24 during stoppage of the movement of the bag web 26. The width of the formed slot may be varied by adjusting the width of the gap 55 and the position of attachment bolts within the slots 46. Blade assembly 49 also includes a tapered blade support 57 which lifts the flap length 25 during extension, to facilitate insertion of the hooks within the formed slots. The flap length 25 is positioned over the blade assembly 49 at all times during operation of the apparatus.

Figure 4:
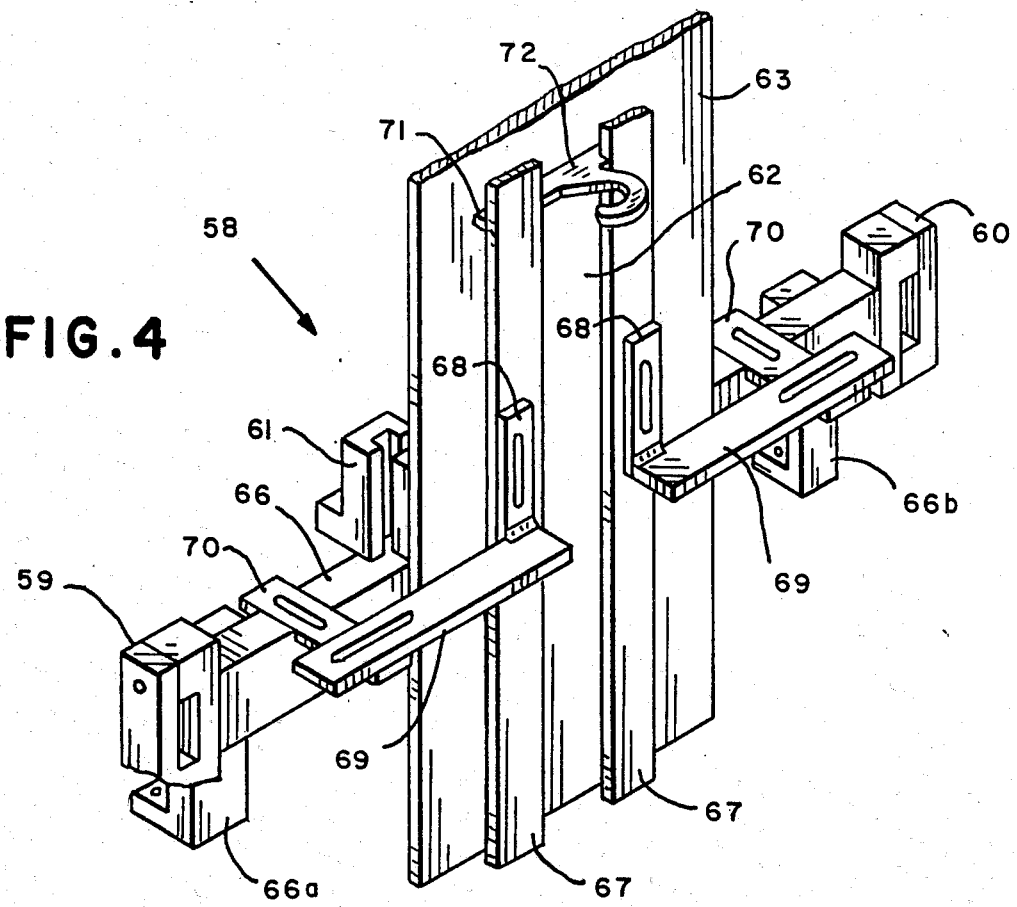
Figure 5:
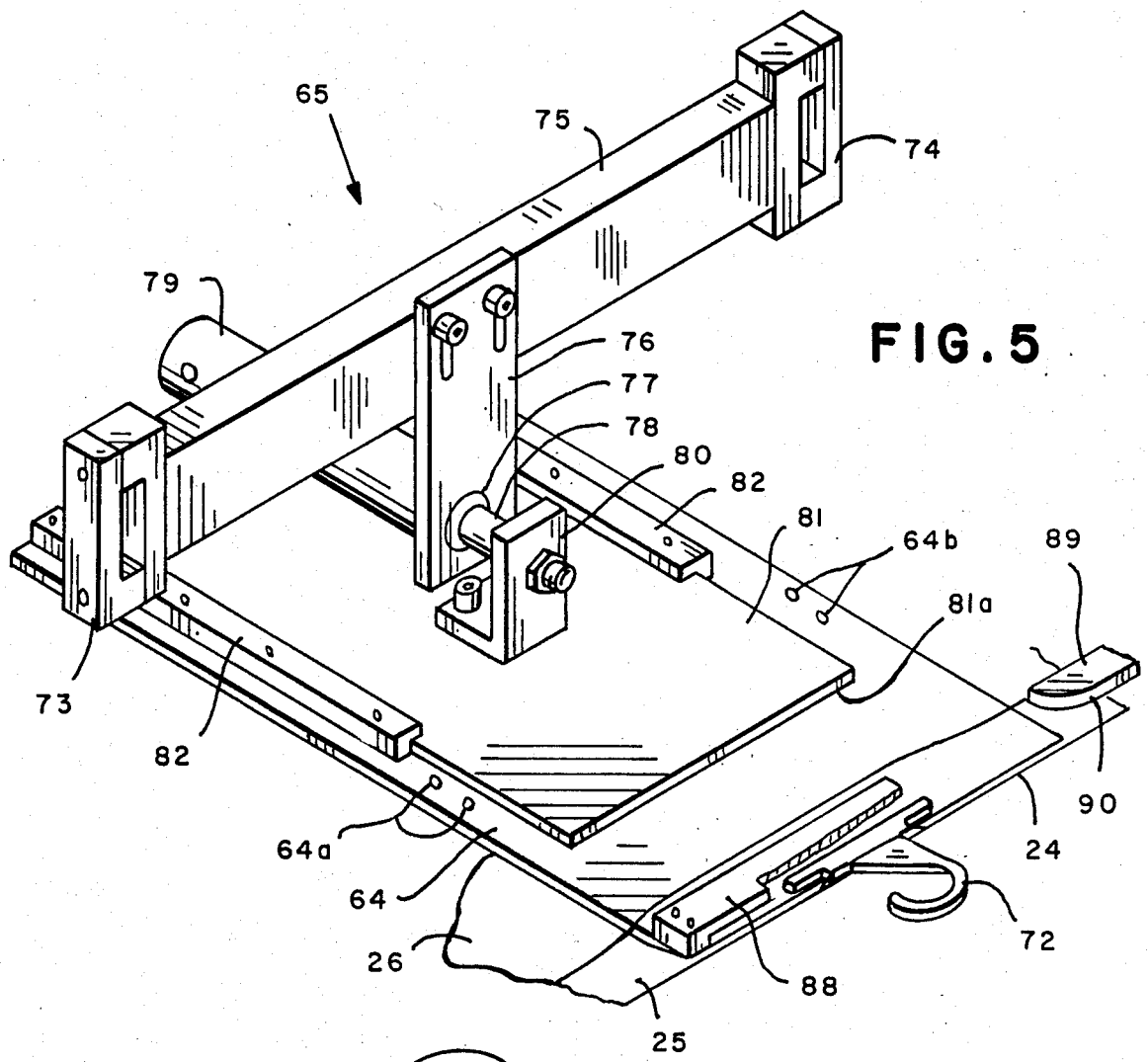

FIG. 4 illustrates a hanger-feeding magazine 58 having attachment clamps 59 and 60 designed to be attached to the opposed bars 42 of the carriage element 33 as shown in FIG. 2 to support the magazine in vertical extension on the carriage element 33 so that the base of the hanger-retainer channel 62 of the vertical guide plate 63 is closely-spaced, by the thickness of a single hanger, above the floor 64 of the hanger-push assembly 75 of FIG. 5. Magazine 63 is vertically adjustably attached to the crossbar 66 by means of slide members 61, and track bars 67 are adjustably attached to cross bar 66 by means of slotted plates 68, 69 and 70 which hold the track bars slightly spaced from the surface of the guide plate 63 to permit the ends of the crossbar 71 of the hangers 72 to be received therebetween, so that a vertical stack of hangers 72 can be retained within the hanger-feeding magazine 58 for gravity feed to the hanger push assembly 65. The slots within the support plates 68, 69 and 70 enable the width of the hanger channel 62 can be varied, as can the space between the track bars 67 and the face of the guide plate 63, and the distance between the base of the track bars 67 and the floor 64 of the assembly of FIG. 5. Similar up and down adjustment of the guide plate 63, to correspond with the base of the track bars 67, enables the use of hangers 72 and hanger crossbars 71 of different sizes and thicknesses.

FIG. 5 illustrates the hanger-push assembly 65 having clamping members 73 and 74 designed to attach the assembly 65 to the opposed bars 42 of the carriage element 33 of FIG. 2. Assembly 65 comprises a crossbar 75 supporting a hanger plate 76 having a transverse bore 77 which receives an elongate bushing 78 through which a pneumatic piston 79 and an angle bracket 80 are connected. Bracket 80 is also attached to a horizontal push plate 81, while the end of the piston 79 is attached to an opposed portion of the carriage element 33, so that reciprocation of the piston stem causes the push plate 81 to be stroked out over the fixed floor 64 of the assembly 65 and beneath the flap length 25. Floor 64 is fixed to the carriage element 33 by means of brackets 66*a* and 66*b* attached to the magazine cross bar 66 of FIG. 4, bolts securing said brackets to the opposed side edges of the fixed floor 64 through holes 64*a* and 64*b*. Floor 64 supports slide guides 82 for the push plate 81. The web 26 advances beneath the floor 64 except for the flap length 25 which is folded over the side edge of floor 64 at all times during operation of the apparatus and is raised to receive the hangers by means of the blade support 57 of the slot-cutting workstation 43 and a raised plate 88 attached to floor 64, as shown in FIG. 5.

Correlating the hanger-feeding magazine 58 of FIG. 4 with the push assembly 65 of FIG. 5, the stack of hangers 72 within channel 62 of the magazine 58 rests upon the floor 64 of the push assembly 65, just in advance of the leading edge 81*a* of the push plate 81 in retracted position. At the same instant that the slot cutter blade 56 of FIG. 3 is being extended to form a hanger-receiving slot beneath the flap length 25 and in the fold 24, as shown by FIG. 1, the hanger push plate 81 is being extended just below the base of the magazine assembly 58 of FIG. 4 to push the lowermost hanger 72 beneath the flap length 25, raised by the tapered support 57 of FIG. 3 and supported over plate 88, into the slot previously formed at the slot-cutting workstation 43. The distance between the workstations and the speed of the bag-forming web 26 permits precision insertion of the hangers 72, and the spacing between the workstations is adjustable to accommodate the production of bags and the use of hangers of different dimensions.

Figure 7:
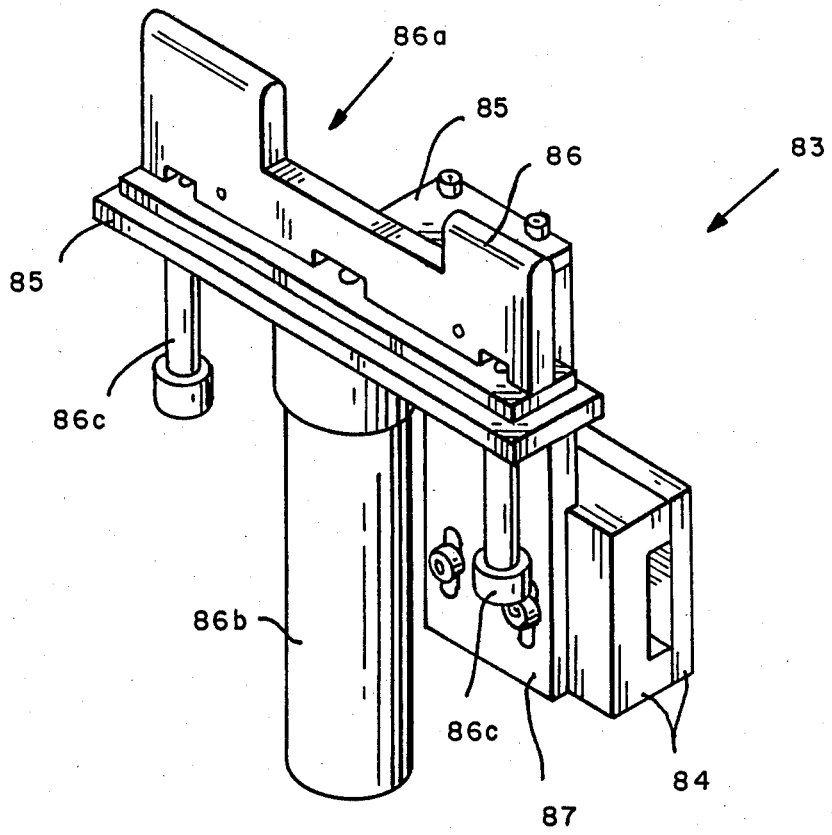

The insertion of the hangers 72 within the slots along web edge 24 by means of the push plate 81 is assisted by a hook-stop assembly 83 shown in FIGS. 1 and 7, comprising a bracket 84 which secures it to the lower parallel side bar 41 of the carriage element 33 and a vertical extension plate 87 supporting a horizontal fixed platform 85 and an adjustable wall stop member 86 mounted for vertical movement up against the edge 24 of the bag web. Stop member 86 has a gap or recess 86*a* which receives the hook portion of the hangers 72 and form stop members for the hanger retainer bar 71. Stop member 86 is supported for reciprocating movement from below the bag web 25 by means of piston 86*b* and slide bolts 86*c* attached thereto, through platform 85 so as to permit withdrawal and movement of the web 25 after insertion of each hanger.

As illustrated by FIG. 5, the floor plate 64 of the push assembly 65 also has attached thereto, adjacent the side edges, a flexible strip 89 and a raised plate 88. Raised plate 88 is supported to extend above the surface of plate 64 to permit the push plate 81 to move thereunder and functions to lift the flap length 25 of the bag web 26 for insertion of the hangers 72 thereunder, into the slots in the flap fold 24. Flexible strip 89 is attached to plate 64 inwardly from the edge thereof and permits the flap length 25 to slide thereunder, beyond the push plate 81, after insertion of the hangers 72 and deflects each hanger retainer bar 71 around the contoured leading edge 90 thereof. This causes each of the hangers 72 to be pushed into a slot in the flap fold 24 and causes the hook portion of each hanger to be received within the gap 86*a* of the hook stop assembly 83 of FIG. 7, the extensions of the crossbar 71 contacting the stop member 86 at each side of the gap 86A to fix the position of each hanger 72, prevent damage to the flap fold 24 and avoid pushing the film web out of alignment.

The stop assembly 83 is synchronized for movement with the push assembly 65 so that the stop member 86 is raised by piston 86*b* while the push plate 64 is pushing a hanger 72 into a slot in flap fold 24, and the stop member 86 is then lowered to permit advancement of the film web.

Figure 6:
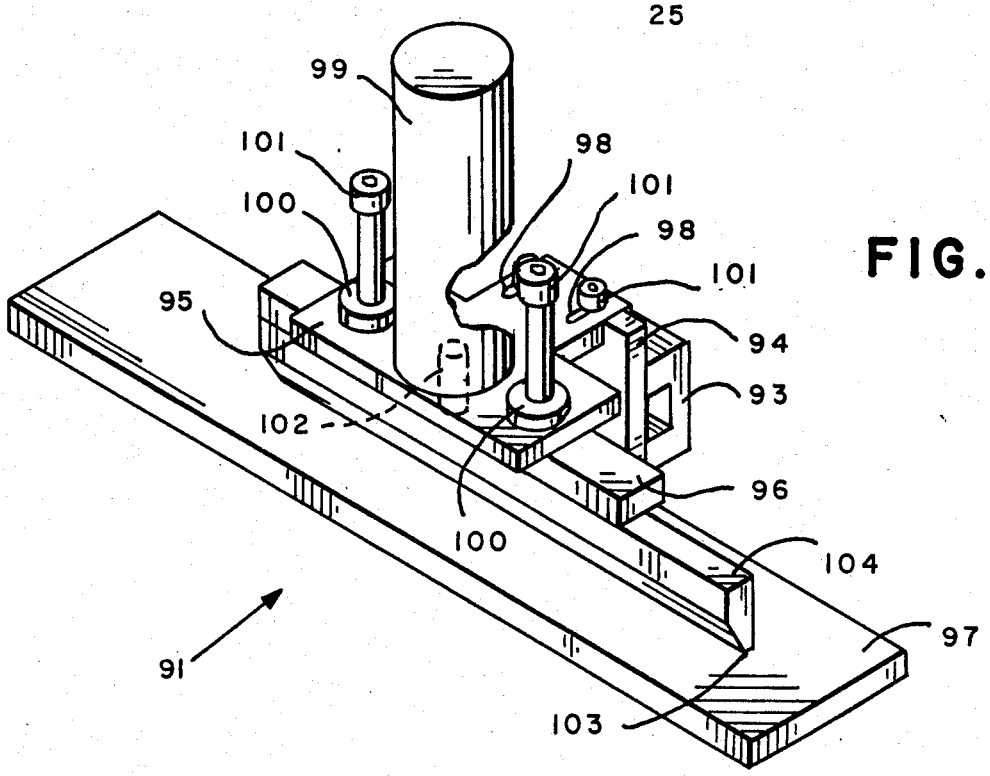

FIG. 6 illustrates the next workstation, namely the heat-sealing assembly 91, in which the flap length 25 of the bag web 26 is heat-sealed to the underlying film ply along a continuous weld line 92, shown in FIG. 1, just below the crossbar 71 of the hanger 72 and above the end 20 of the upper film ply, in order to confine the hanger within a narrow film sleeve at the top of the bag web 26 with the hook extended through the slot formed in station 43.

The heat-sealing assembly 91 comprises a clamp 93 which supports the assembly 91 on the extension arm 40 of the carriage element 33. Clamp 93 is fastened to wall plate 94 to which is fastened, in spaced relationship, a top piston-support plate 95 to which is connected an intermediate heat/pressure plate 96, and a lower backing board 97. The piston support plate 95 is attached to wall plate 94 by bolts through elongate slots 98 which permit the piston 99 and heat pressure plate 96 to be adjustably-supported relative to the web edge 24, to adjust the width of the hanger-confining sleeve to be formed. The upper plate 95 threadably engages the piston housing and supports bushings 100 and slide bolts 101 which threadably engage the heat/pressure plate 96, as does the piston rod 102. Energization of the pneumatic piston 99 causes the heat/pressure plate 96 to be depressed to confine the edge of the flap length, inwardly of the hanger crossbar 71, between the lower edge 103 of the heated bar 104 of the heat/pressure plate 96 and the upper surface of the backing board 97. The heat and pressure are adjusted in order to heat fuse the flap length to the underlying ply of the bag web 26 and form a continuous heat weld line 92, shown in FIG. 1, without any cutting or burn-through. This forms a narrow film sleeve inwardly from the edge 24 of the bag web and outwardly of the open end 26 of the double film ply, to confine the hangers 72 in inserted position without any fusion or other adhesion of the hangers 72 directly to the bag web 26 and without preventing access to the interior of the final bags. Such free confinement permits the use of hangers 72 of various compositions.

Figure 1B:
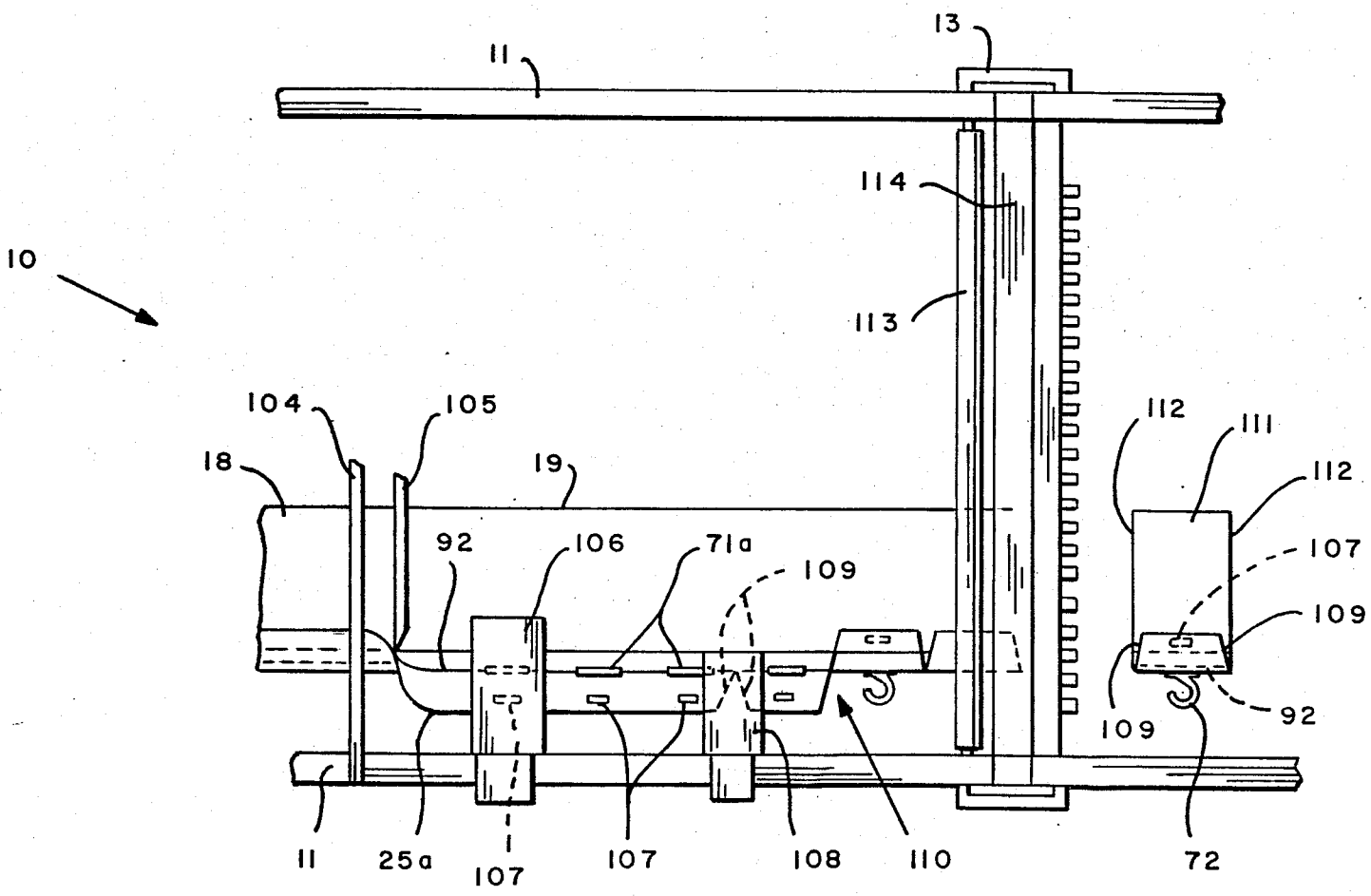

After the heat-sealing workstation 91 the web passes over roller 104 and under the blunt tip of a rod 105 which unfolds the flap length 25 to extended position 25*a* in which the underside of the flap length 25 faces upwardly and the hangers 72 are deflected downwardly into a channel and the underside 71*a* of the hanger crossbars 71 face upwardly, as shown in FIG. 1B. In such position the bag web 26 is transported through additional workstations supported on the extension bar 40 of the carriage element 33, such as an adhesive tape-application station 106 which applies spaced masked adhesive sealing tabs 107 to the underside of the flap length 25, a V-cutter station 108 which forms contoured bag flaps 109. A flap-reversion station 110 which folds the flaps 109 back over the bag web 92 is supported by the apparatus in advance of the entry of the web 26 into a heat-cutting station 114 which simultaneously cuts and fuses the bag web 26 across its width to form individual hangered bags 111 having fused sides 112, shown by FIG. 1.

When all of the workstations in advance of the heat cutting station 114 are secured to an adjustable carriage element 33, they move therewith whenever the carriage element is loosened by knob bolts 38 and repositioned to center the bag features relative to the final cutting locations, as may be necessary when film creepage causes loss of alignment and/or bag width. Thus, a slight repositioning of the carriage, usually less than one inch in either direction, recenters all of the workstations to produce perfect bags. Repositioning of the carriage element 33 is possible because the length of the carriage element 33, including extension arm 40, is substantially less than the overall length of the side weld bag making machine 10, and the extent of movement is minor. Also, the workstations are adjustably secured to the carriage elements 33 and 33' to permit relative adjustment thereof so that the stations can be repositioned on either or both carriages for the making of bags of different sizes on both sides of the tandem machine simultaneously.

Movement of the web to and through the heat cutting station 114 is caused by the pulling of the web in the nip between reverse-revolving drive rollers 113, the top one of which is shown in FIG. 1, just in advance of the heated cutting station 114. The individual cut bags 112 pass between reverse revolving belts for movement to a stacking station for final packaging.

As noted above, the novel apparatus and method of the present invention enable an expensive tandem side weld bag-making machine to be used for the simultaneous manufacture of different-sized bags and/or bags of different film composition but incorporating hangers of the same or different plastic compositions. As is clear to those skilled in the art, the positions of the workstations relative to the final heat cutter station and relative to each other must be adjusted so that the work performed on each bag section is centered to form bags of perfect appearance and balance.

The novel system or method according to a preferred embodiment of the present invention comprises continuously drawing an elongate multi-ply film web to be treated through a plurality of workstations aligned along one edge of a length of the web, mounting the aligned workstations on a support or carriage which is adjustable along the length of the web so that the workstations can be moved simultaneously and in predetermined spaced relationship while the web is still moving, to enable the fixed repositioning of the carriage and its workstations whenever the tension applied to the web, web interchange or other factors, cause it to creep to the extent that the physical changes or features applied to the web in the workstations become out of alignment with the final bag cutting station. When this occurs, all of the operations performed upon the web at the workstations are recentered relative to the final cutting station by the simple repositioning of the carriage so that the finally-formed bags contain the applied features, such as flaps, hangers, adhesive tabs, etc., in perfectly-centered position.

The novel apparatus of the present invention also comprises a hanger-insertion mechanism which makes it possible to automatically produce hangered plastic pouches and bags on conventional pouch-and bag-making machines which were unsuitable for such use prior to the present invention. While such hanger-insertion mechanism, including the vertical feed magazine of FIG. 4, the horizontal push assembly of FIG. 5 and the retractable stop assembly of FIG. 7, most preferably are mounted on a unitary adjustable carriage as shown in FIG. 2, it is also possible to mount these workstation components directly on the side rail of the conventional pouch-and bag-making machines to adapt such machines to the continuous automatic production of hangered bags and pouches.

It will also be clear to those skilled in the art that the present apparatus is useful for forming plastic display bags of various different types from webs folded or superposed in different manners. For example, bottom load or bottom fill bags may be produced from two plies of film, the bottom ply being wider to provide a narrow flap length which receives the hangers and is then heat-fused to the top ply to confine the hangers and simultaneously seal the bags at the top, leaving the opposite or bottom edge open for eventual filling and heat-sealing of the bags for the display of goods which are inaccessible without tearing of the bags. If desired, a flap may be formed at the bottom edge, instead of a heat seal, to permit access.

It will be apparent to those familiar with conventional automatic bag-making machines that the present apparatus incorporates a motor for driving the web-advancing drive rollers 113, said motor including adjustable timer means for regulating the on/off cycle of the motor to correspond to the distance between workstations, since the web is stationary when the workstations are activated. Electrical circuitry is added for energizing the various pistons, heated means, timer means and other electrical components associated with the various workstations to cause the synchronous operation of the activated workstations.

Variations and modifications of the present invention will be apparent to those skilled in the art within the scope of the present claims.

I claim:

1. An elongate bag-making apparatus for automatically producing a plurality of hangered plastic bags, said apparatus comprising (a) a horizontal frame having opposed ends and opposed elongate sides, (b) means for dispensing a continuous elongate web of thermoplastic film in folded multi-ply relationship adjacent one end of said frame for generally horizontal movement of said web over said frame to the other end thereof, said web including a narrow elongate flap ply formed by folding said film upwardly along a fold line forming one elongate side edge of said web adjacent one side of said frame and inwardly towards the center area of said web, whereby the opening beneath said flap ply faces the center area of said web, (c) a carriage element, (d) elongate track means including an elongate side rail of said frame for supporting said carriage element over the center area of said web for adjustable positioning along a portion of the length thereof, (e) a plurality of workstations mounted on said carriage element in predetermined spaced relation to each other and to said elongated flap ply along the length of said web for simultaneously applying a plurality of physical bag features thereto, said workstations comprising (i) a slitting means comprising a slitting blade extendable from the center area of said web outwardly beneath said flap ply to form a succession of evenly-spaced narrow slits in said fold line, along the length thereof, and (ii) a hanger supplying and insertion means spaced beyond said slitting means and comprising a means for supplying a succession of flat hangers, each having a narrow central hook portion and an elongate retainer bar portion, to a position above and adjacent the center area of said web, and a means for pushing outwardly against the retainer bar portion of each said hanger to slide each hanger horizontally outwardly, beneath said flap ply, to insert the hook portion thereof through a said slit in said fold line and to engage the bar portion thereof with said fold line, said apparatus also comprising (f) a means spaced beyond said hanger supplying and insertion means for heat-sealing said flap ply to the underlying film ply along a narow line inwardly from the bar portions of each hanger, to confine each inserted hanger within said flap ply with the hook portions extending outwardly through each said narrow slit, (g) a cutting means adjacent the other end of said frame for forming a plurality of uniformly-spaced, heat fused transverse cuts which segregate said web into a plurallity of uniform, hangered plastic bags, and (h) a means for pulling said elongate web from said dispensing means to said cutting means, the adjustable positioning of said carriage element permitting said element to be repositioned along the length of the web, relative to the location of the cutting station, in order to simultaneously adjust the distance between each of the workstations mounted on the carriage element and said cutting means and thereby center the location of each said hanger relative to the flap ply on each said uniform hangered plastic bag.

2. An apparatus according to claim 1 in which said means for dispensing comprises means for folding said web of thermoplastic film along its other side edge of its length to form a double ply of the film over a major portion of the width of the web, and means for folding said web along said one side edge of its length to form said flap ply, a portion of which overlaps said double ply to form a triple ply.

3. A apparatus according to claim 1 in which said carriage element comprises a carriage frame which is elongate along at least the side thereof adjacent the side rail of the frame of the apparatus, said carriage frame comprising spaced brackets at said side which slideably engage the side rail of said apparatus frame, and comprising spaced wheels at the opposed side which engage said elongate track means to support said carriage element for said adjustable positioning.

4. An apparatus according to claim 3 in which said brackets are provided with releasable means for locking said carriage element to said frame to prevent movement thereof.

5. An apparatus according to claim 3 in which said spaced wheels each comprise an upper wheel which rides on top of said elongate track means and a lower cam means which engages an undersurface of the track means to lock the carriage element against movement during operation of the apparatus.

6. An apparatus according to claim 1 in which said means for automatically supplying a succession of hangers comprises a vertical magazine for gravity-feeding a succession of hangers, each having a hook portion and retainer bar portion, and said sliding means comprises a horizontal push means for pushing against the retainer bar portion of each of said hangers, in succession, to push the hook portion into a said opening and push the retainer bar portion into contact with said fold line forming said flap ply.

7. An apparatus according to claim 1 comprising a tandem apparatus having a wide horizontal frame (a), a parallel pair of said dispensing means (b) for dispensing parallel webs of said film, each web having its fold line and flap ply adjacent elongate side rail of the frame, a parallel pair of said carriage elements (c) and track means (d) supporting said workstations (e) for forming spaced slits and inserting hagers beneath the flap ply on each of said webs, a parallel pair of said heat-sealing stations (f), cutting means (g) to segregate each of said webs into a plurality of uniform hangered bags, and pulling means (h) for pulling each of said webs to the cutting means.

8. An apparatus according to claim 1 in which the said slitting means on said carriage element also comprises a back up member for engaging the edge of the web at the fold line and having a gap therein to receive said slitting blade during the formation of said spaced slits along said fold line.

9. An apparatus according to claim 1 in which said hanger supplying and insertion means is associated with an elongate stop member which also is mounted on said carriage element for vertical movement up to a position parallel to the fold line in said web each time that a hanger is pushed into a slit in said fold line, said stop member having a gap therein which receives the hook portion of each pushed hanger, and adjacent stop surfaces which engage the fold line of the web for contact with the bar portion of each pushed hanger.

10. An apparatus according to claim 1 in which said heat sealing means (f) is also mounted as a workstation on said carriage element.

11. An apparatus according to claim 1 in which said carriage element comprises an elongate extension bar, parallel to the elongate side rail of said frame, onto which one or more of said workstations are mounted.

* * * * *